US006462727B2

(12) United States Patent
Shin

(10) Patent No.: US 6,462,727 B2
(45) **Date of Patent: *Oct. 8, 2002**

(54) DRIVING CIRCUIT WITH LOW OPERATIONAL FREQUENCY FOR LIQUID CRYSTAL DISPLAY

(75) Inventor: Min Cheol Shin, Kyungsangbook-do (KR)

(73) Assignee: LG.Philips LCD Co., Ltd., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 09/982,872

(22) Filed: Oct. 22, 2001

(65) Prior Publication Data

US 2002/0024490 A1 Feb. 28, 2002

Related U.S. Application Data

(63) Continuation of application No. 09/006,592, filed on Jan. 13, 1998, now Pat. No. 6,323,836.

(30) Foreign Application Priority Data

May 16, 1997 (KR) ..... 97-19027

(51) Int. Cl.[7] ..... G09G 3/36

(52) U.S. Cl. ..... 345/99; 345/98; 345/214

(58) Field of Search ..... 345/98, 99, 100, 345/92, 210, 211, 212, 213, 214, 196, 507, 509, 508, 505

(56) References Cited

U.S. PATENT DOCUMENTS

| | | | | | |
|---|---|---|---|---|---|
| 4,611,228 | A | * | 9/1986 | Machida et al. | 358/149 |
| 5,192,945 | A | * | 3/1993 | Kusada | 340/784 |
| 5,790,111 | A | * | 8/1998 | Wood et al. | 345/213 |
| 5,790,136 | A | * | 8/1998 | Hoffert et al. | 345/506 |
| 5,856,818 | A | * | 1/1999 | Oh et al. | 345/99 |
| 6,037,925 | A | * | 3/2000 | Kim | 345/99 |
| 6,147,672 | A | * | 11/2000 | Shimamoto | 345/150 |
| 6,219,023 | B1 | * | 4/2001 | Kim | 345/698 |
| 6,320,566 | B1 | * | 11/2001 | Go | 345/99 |
| 6,323,836 | B1 | * | 11/2001 | Shin | 345/99 |

FOREIGN PATENT DOCUMENTS

| | | |
|---|---|---|
| JP | 61-52631 | 3/1986 |
| JP | 5-61444 | 3/1993 |

* cited by examiner

*Primary Examiner*—Bipin Shalwala
*Assistant Examiner*—Mansour M. Said
(74) *Attorney, Agent, or Firm*—McKenna Long & Aldridge LLP

(57) ABSTRACT

A driving circuit for driving a liquid crystal display is provided. The driving circuit includes a clock generator processing a first clock signal to output a second clock signal, the clock speed of the second clock signal being half of that of the first clock signal, a memory for storing a first video data and a second video data in accordance with the first clock signal, and a data controller for simultaneously outputting the first video data and the second video data stored in the memory in accordance with the second clock signal.

3 Claims, 10 Drawing Sheets

DRIVING CIRCUIT WITH LOW OPERATIONAL FREQUENCY FOR LIQUID CRYSTAL DISPLAY

This application is a continuation of Ser. No. 09/006592 filed on Jan. 13, 1998, U.S. Pat. No. 6,323,836.

This application claims the benefit of Korean Application No. P97–19027, filed in Korea on May 16, 1997, which is hereby incorporated by reference.

BACKGROUND OF THE INVENTION

1. Field of the Invention

The present invention relates to a liquid crystal display (LCD), and more particularly, to a driving circuit for driving the LCD.

2. Discussion of the Related Art

Cathode ray tubes (CRTS) are widely used in display devices for television sets and display monitors for computers, because a CRT can easily reproduce color and it has high respond speed. However, CRTs are too large, heavy and consume too much power to be portable. Because of this, it is desirable to replace the CRT with other types of display. To overcome the above mentioned disadvantages of the CRT, a considerable amount of research and development has been conducted to design alternative types of display, such as liquid crystal displays, plasma display panels, and so on. Among them, a liquid crystal display is one of the most generally used devices because the LCD does not have the bulky electron gun like the CRT, and the LCD can be applied to a thin television set to be mounted on the wall. Furthermore, the LCD can be applied to a portable display device, such as a note-book computer, because the power consumption is very low, and accordingly, the LCD can be driven by a battery.

The schematic structure of a conventional LCD is shown in FIGS. I and 2. FIG. 1 shows 20 the perspective view, and FIG. 2 shows the structure of the lower panel. The LCD includes an upper panel 21, which has a polarization plate 20, a color filter 22, and a common electrode 23; a lower panel 25, which has thin film transistors (TFTs) 13 and pixel electrodes 26; and a liquid crystal material 24 inserted between the upper panel 21 and the lower panel 25. The lower panel further includes a plurality of scan lines 14 and a plurality of data lines 15. The scan lines 14 and the data lines 15 perpendicularly cross each other. At the area surrounded by the neighboring scan lines and data lines, the pixel electrode 26 is formed. At each of the intersections of the scan lines and data lines, the TFT 13 is formed. Each of the area surrounded by the neighboring scan lines and data lines is called a pixel. Thus, the pixel includes the pixel electrode 26, the common electrode 23, and the liquid crystal material 24 in between. In addition, the lower panel 25 further has a data driver IC 11 connected to the data lines 15 and a scan driver IC 10 connected to the scan lines 14 (FIG. 2).

The TFT includes a gate electrode, a source electrode and a drain electrode. The gate electrode is connected to the (an line, the source electrode is connected to the data line, and the drain electrode is connected to the pixel electrode. The drain electrode and the source electrode are connected with a semiconductor layer of the TFT. The TFT works as a switch that passes a data voltage applied to the data line to the drain electrode when a scan voltage is applied to the gate electrode through the scan line. The data voltage applied to the drain electrode is in turn applied to the pixel electrode connected to the drain electrode.

Video data are applied from a controller 17 to the data driver IC 11. The video data include grey scaled data of red (R), green (G), and blue (B), which are applied to the corresponding pixel electrodes 26. The data driver IC 11 latches the video data, which come from the controller IC 17, until all the data of one line are inputted. Then, the video data of one line is transferred to the data line, one at a time. At that time, the scan driver IC 10 applies a scan voltage to the scan line 14 connected to TFTs 13 to reproduce the video image at the pixel electrodes 26 according to the scan signal of the controller 17.

When the scan voltage is applied to a scan line, the TFTs connected to the scan line are turned on. Accordingly, the video data applied to the data lines are sent to the pixel electrodes through the TFTs. Therefore, a voltage is applied to each pixel electrode. On the other hand, constant voltage is applied to the common electrode. Accordingly, a voltage difference is formed between the pixel electrode and the common electrode, and an electric field is formed by the voltage difference. The arrangement (or orientation) of the liquid crystal molecules between the pixel and common electrodes is changed according to the electric field, and the amount of light transmission at the pixel is modulated. That is, there are differences in light transmission at the pixels applied with a data voltage and the pixels not applied with a data voltage. Using these properties of pixels, the LCD works as a display device.

Since there are many data lines in the LCD in general, a plurality of data drivers are necessary, as shown in FIG. 3. The plurality of the data driver ICs are connected to the controller IC 17 via a bus line 18. The data driver ICs 11' latch the sequentially applied video data, until video data for one line are all inputted. Then, these one-line data are sent to the data lines 15 at one time. As the number of data lines increases, a faster clock signal is required for each controller IC. That is, the frequency of the clock signal of the controller IC needs to be higher in high resolution LCD panels. As a result, the high frequency of the clock signal is one of the causes of increasing the electrical load at the controller IC and the peripheries.

To solve the problem associated with the high frequency clock signal, a divided driving method, as shown in FIG. 4, and a double bank driving method, as shown in FIG. 5, have been used for sending video data to the data driver IC.

In the divided driving method shown in FIG. 4, the data driver ICs are divided into two groups A and B, and the video data are sent to and latched at the two groups. When the video data for the first line (the first row of pixels) are applied to the controller IC 17, the controller IC 17 stores the video data for the group A and the group B in a memory. When the video data for the second line (the second row of pixels) are applied to the controller IC 17, the stored first line data are simultaneously sent to the groups A and B of data driver ICs 30, 31, respectively. Therefore, the frequency of the clock signal can be made half of that for the LCD of FIG. 3.

In the double bank driving method shown in FIG. 5, the data driver ICs are divided into two groups. One group, an odd data driver IC group 32, is the driver for ICs connected with the odd numbered data lines; the other group, an even data driver IC group 33, is for the driver ICs connected to the even numbered data lines. The driver ICs are disposed at both sides of the panel. This way, the frequency of the clock signal can be made half of that for the LCD shown in FIG. 3.

However, in the divided driving method, it is necessary to install a number of memories for storing the video data. This is especially true for a high resolution LCD, which requires a large number of data lines, which in turn requires a large capacity in the memory for storing the video data. In the double bank driving method, since the driver ICs are disposed at the two sides of the panel, the visible area of the display panel is smaller than that for the single bank mode in which the driver ICs are disposed at only one side of the panel. Furthermore, in the COG (Chip On Glass) technique, the above mentioned problems are more serious.

SUMMARY OF THE INVENTION

Accordingly, the present invention is directed to a driving circuit for a liquid crystal display that substantially obviates the problems due to limitations and disadvantages of the related art.

An object of the present invention is to provide an improved driving circuit for a liquid crystal display that has a low power consumption and a small occupation area.

Another object of the present invention is to provide an improved driving circuit for a liquid crystal display in which the frequency of the clock signal is less than half of the conventional driving circuit with a single bank mode structure.

Additional features and advantages of the invention will be set forth in the description that follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the present invention provides a driving circuit for driving a liquid crystal display, including a clock generator processing a first clock signal to output a second clock signal, the clock speed of the second clock signal being half of that of the first clock signal; a memory for storing a first video data and a second video data in accordance with the first clock signal; and a data controller for simultaneously outputting the first video data and the second video data stored in the memory in accordance with the second clock signal.

In another aspect, the present invention provides a driving circuit for driving a liquid crystal display, including a clock generator processing a first clock signal to output a second clock signal, the clock speed of the second clock signal being a third of that of the first clock signal; a memory for storing a first video data, a second video data, and a third video data in accordance with the first clock signal; and a data controller for simultaneously outputting the first video data, the second video data, and the third video data stored in the memory in accordance with the second clock signal.

In another aspect, the present invention provides a driving circuit for driving a liquid crystal display, including a clock generator for processing a first clock signal to output a second clock signal, the clock speed of the second clock signal being one Nth of that of the first clock signal with N being a positive integer; a memory for storing N sets of video data in accordance with the first clock signal; and a data controller for simultaneously outputting the N sets of video data stored in the memory in accordance with the second clock signal.

In another aspect, the present invention provides a driving device for driving a liquid crystal display in accordance with an input video signal, the driving device including a memory having a plurality of memory areas; and a data processor serially sampling the input video signal in accordance with a first clock signal to temporarily store the sampled video signal in the plurality of memory areas of the memory, the data processor serially outputting the stored video signal concurrently from all of the plurality of memory areas in accordance with a second clock signal whose clock speed is slower than that of the first clock signal, the data processor constantly updating the data in the memory by the video signal that are being sampled while the previously stored video signal are being outputted from the memory.

In a further aspect, the present invention provides a liquid crystal display device displaying a video image in accordance with an input video signal, the liquid crystal display including a first substrate including a plurality of data lines, a plurality of scan lines substantially perpendicularly crossing with the plurality of data lines, a plurality of pixels electrodes each disposed at areas surrounded by the scan lines and data lines, and a plurality of thin film transistors each disposed at the respective intersection of the data lines and the scan lines, the gate of the thin film transistor being connected to the adjacent scan line, the source of the thin film transistor being connected to the adjacent data line, and the drain of the thin film transistor being connected to the adjacent pixel electrode; a second substrate opposite the first substrate; a liquid crystal material interposed between the first substrate and the second substrate; a memory having a plurality of memory areas; a data processor serially sampling the input video signal in accordance with a first clock signal to temporarily store the sampled video signal in the plurality of memory areas of the memory, the data processor serially outputting the stored video signal concurrently from all the plurality of memory areas in accordance with a second clock signal whose clock speed is slower than that of the first clock signal, the data processor constantly updating the data in the memory by the video signal that are being sampled while the previously stored video signal are being outputted from the memory; and a plurality of data drivers connected to the data lines for latching the video signal outputted from the data processor to simultaneously output pixel driving signals for one row of the pixels to the plurality of data lines on the first substrate.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Figure 1:
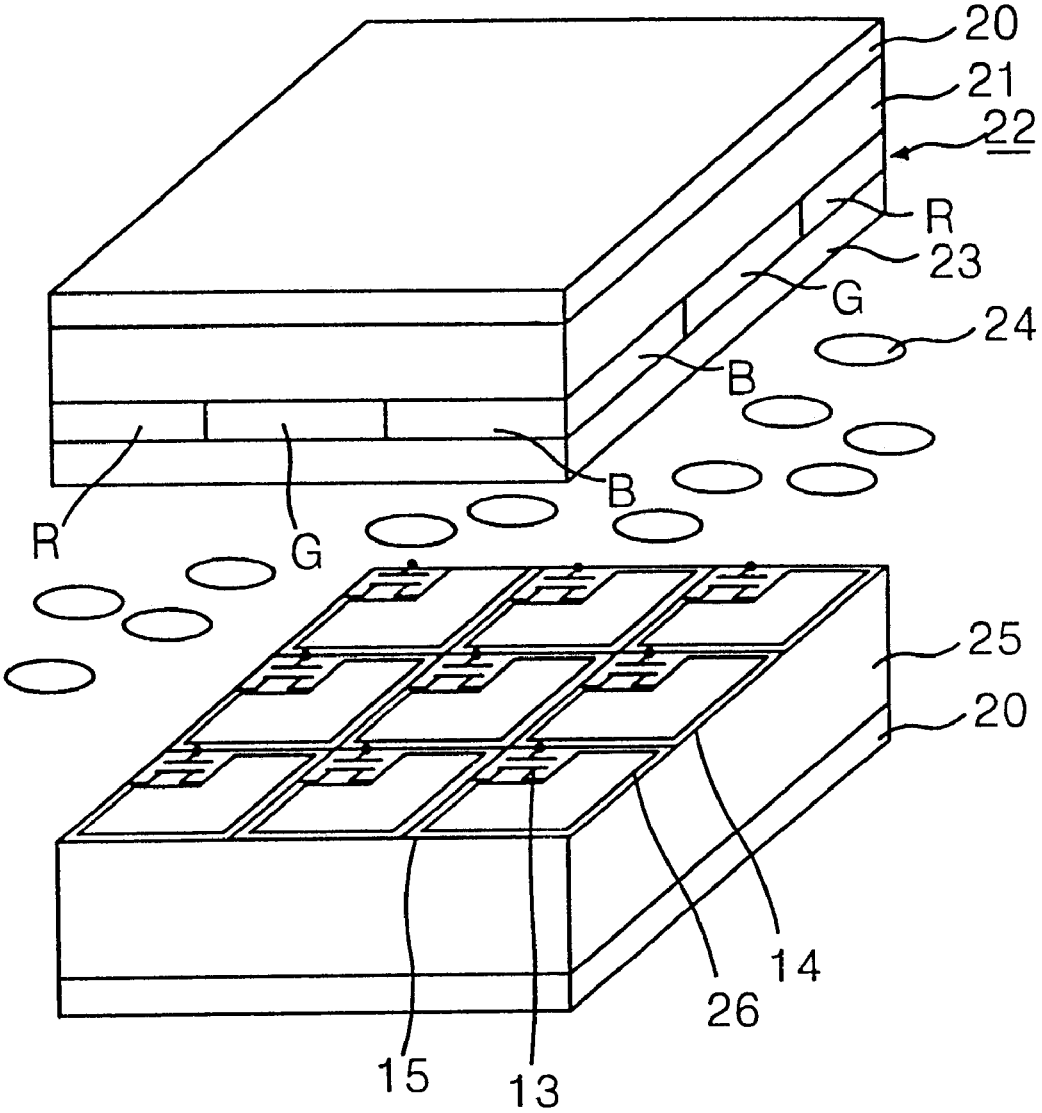
FIG. 1 CONVENTIONAL ART
FIG. 1 is a perspective schematic view of a conventional liquid crystal display device.
Figure 2:
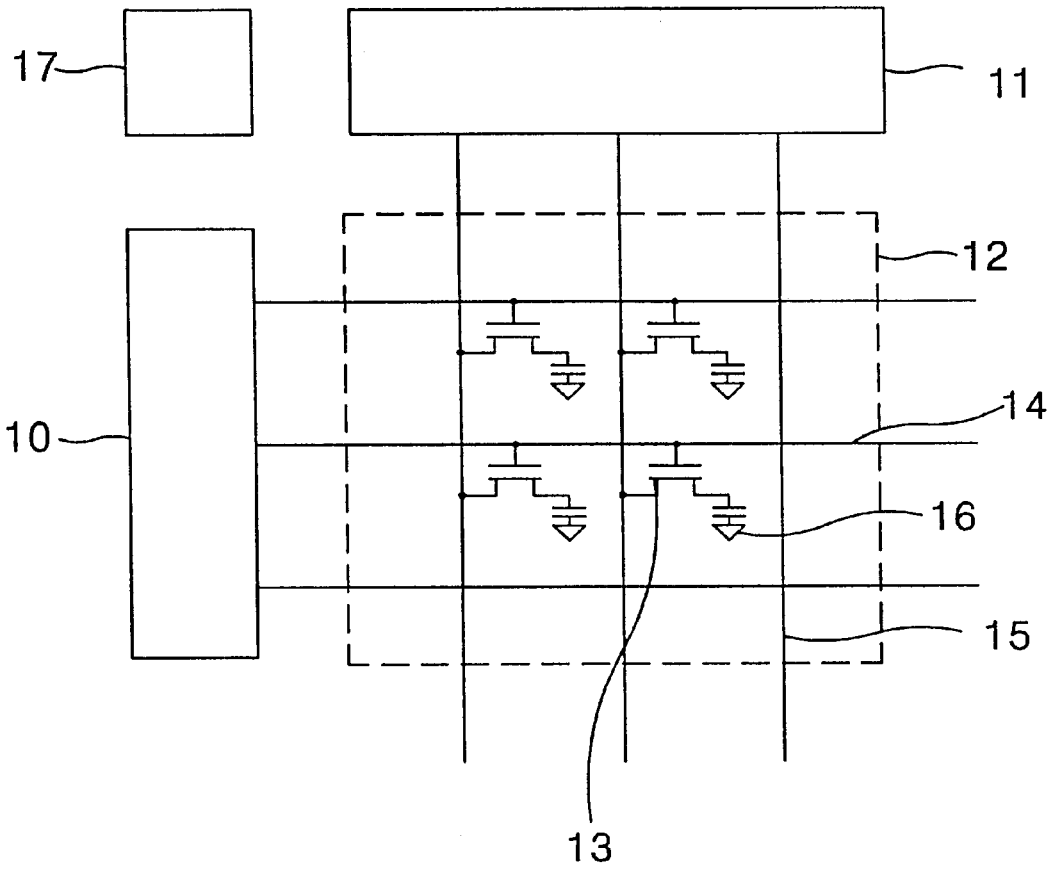
FIG. 2 CONVENTIONAL ART
FIG. 2 schematically shows the structure of the lower panel of the LCD of FIG. 1.
Figure 3:
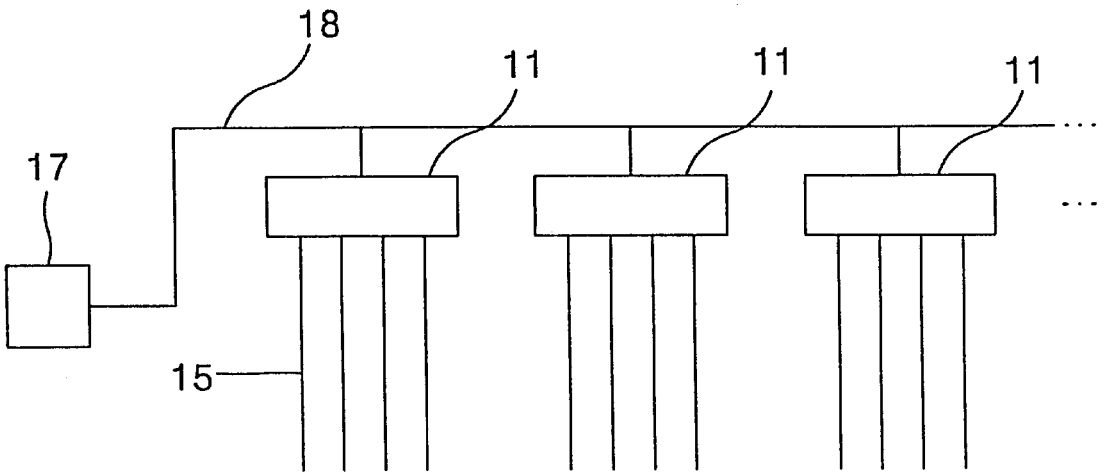
FIG. 3 CONVENTIONAL ART
FIG. 3 schematically shows the arrangement of data driver ICs in the LCD of FIG. 1.
Figure 4:
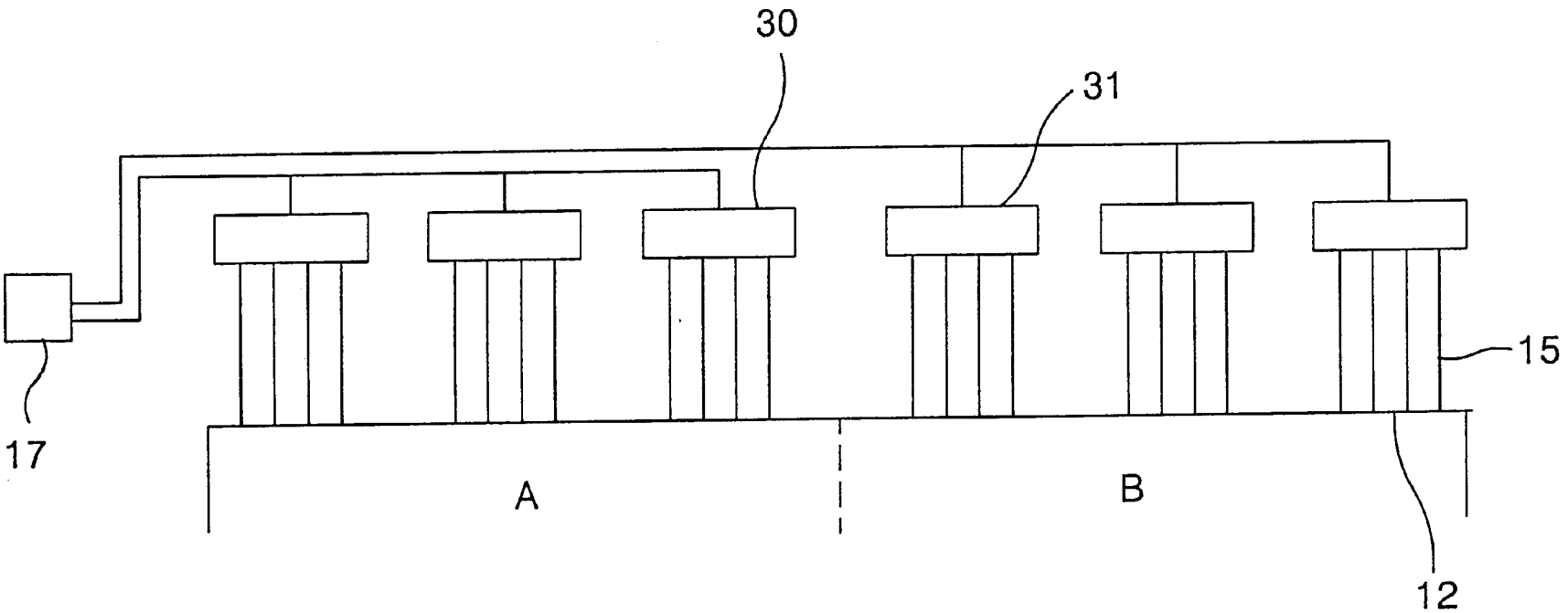
FIG. 4 CONVENTIONAL ART
FIG. 4 shows the arrangement of data driver ICs using a conventional divided driving method for an LCD.
Figure 5:
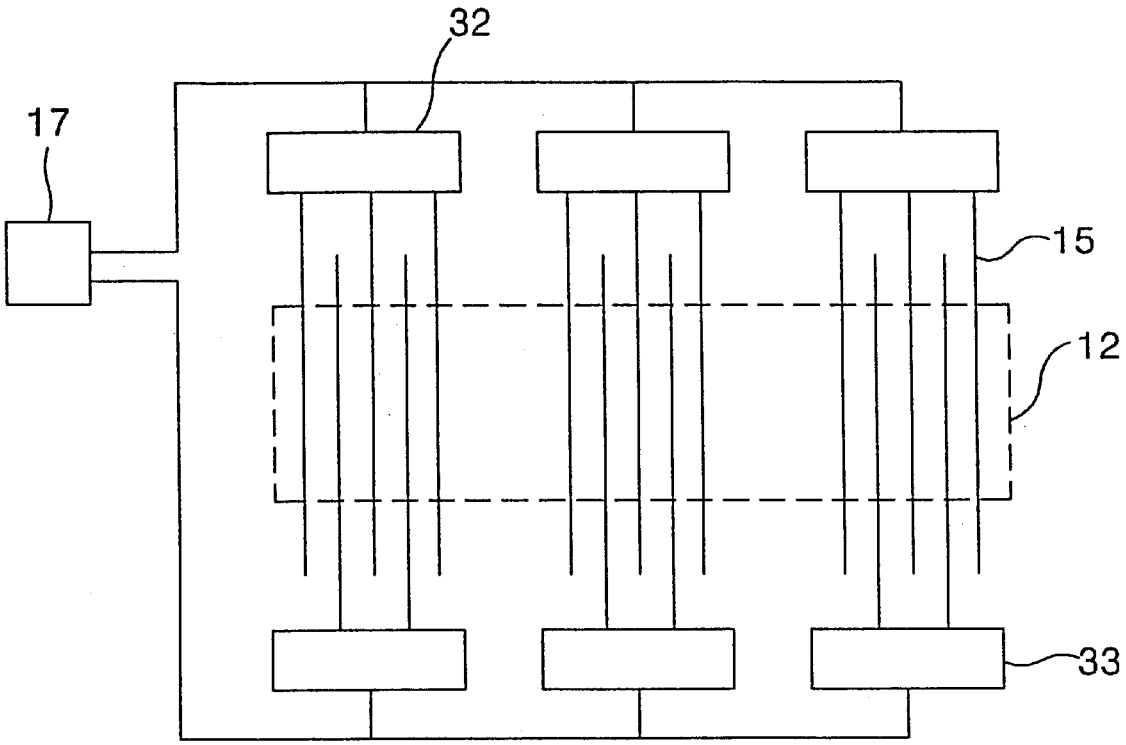
FIG. 5 CONVENTIONAL ART
FIG. 5 shows arrangement of data driver ICs using a conventional double bank method for an LCD in conventional art.
Figure 6:
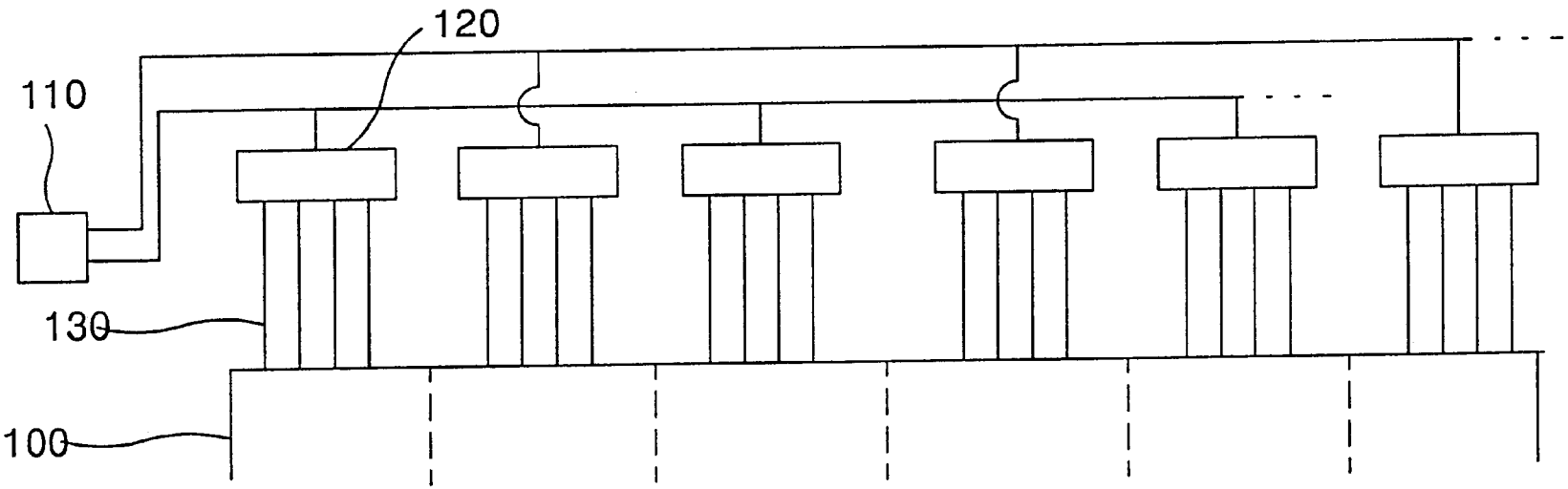
FIG. 6 CONVENTIONAL ART
FIG. 6 shows a structure of an LCD according a first preferred embodiment of the present invention.

In the present invention, the display panel 100 is divided into a plurality of areas (as shown in FIG. 6, for example). At one side of the panel 100, a driver IC 120 is disposed for each divided area. The driver ICs 120 are grouped into two groups, an odd group and an even group, for example. The driving circuit is designed to apply the video data to the driver ICs 120 at the same time. Thus, the present invention has a single bank structure, and its frequency is less than half of the conventional driving circuit.

First Preferred Embodiment

Figure 7:
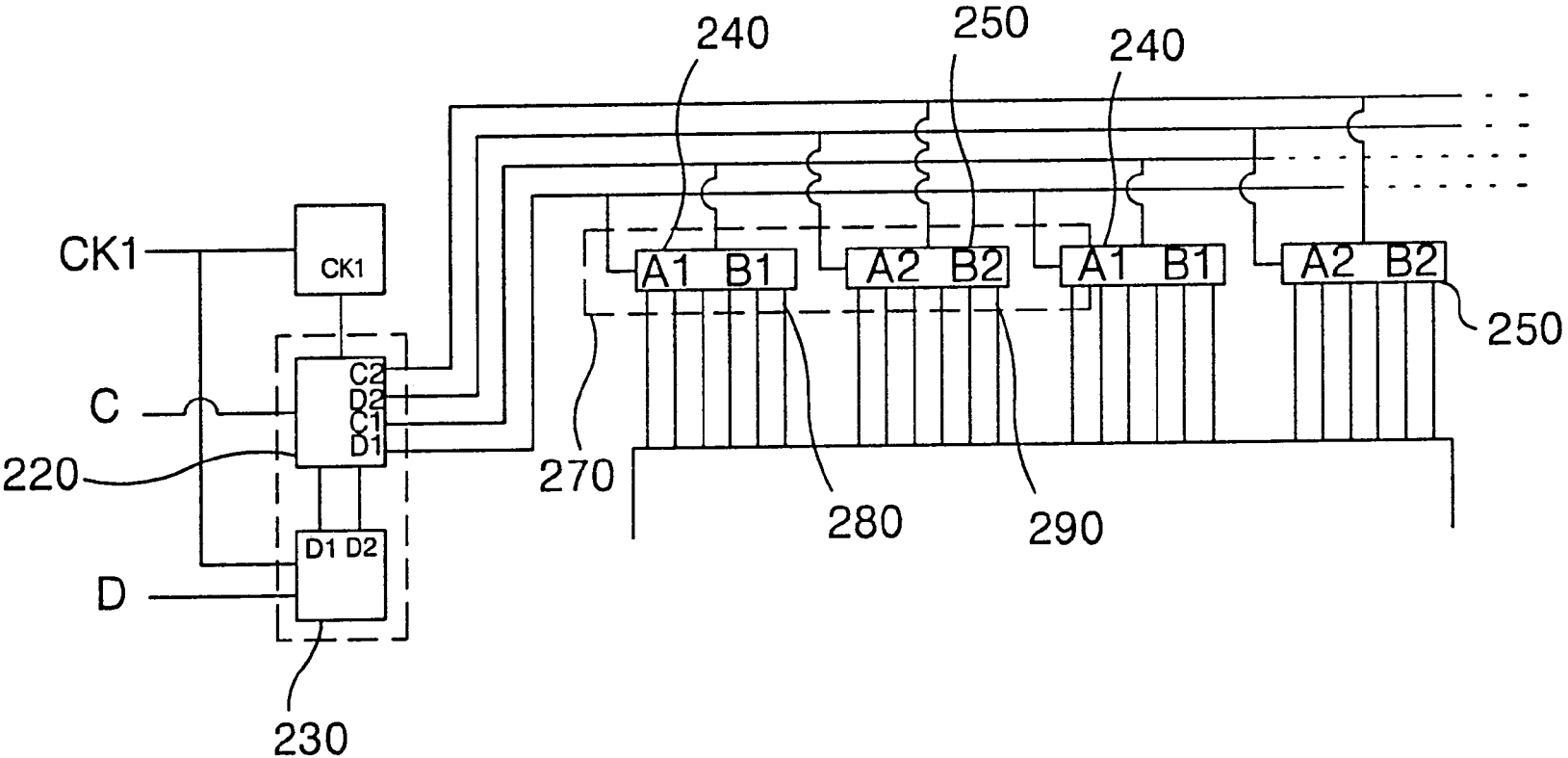
FIG. 7 is a block diagram showing the driving circuit for an LCD according to the first preferred embodiment of the present invention.

As shown in FIG. 7, driving circuit according to a first preferred embodiment of the present invention includes a clock generator 200 having an input terminal for receiving a first clock signal CK1 and an output terminal for outputting a second clock signal CK2; a data controller 210 having an input terminal for receiving a data signal D and output terminals for outputting an odd video signal D1, an odd control signal C1, an even video signal D2, and an even control signal C2; a plurality of odd data driver ICs 240 each having a control input terminal B1 connected to the odd control signal terminal C1, a data input terminal A1 connected to the odd video signal terminal D1, and odd data output terminals 280; and a plurality of even data driver ICs each having a control input terminal B2 connected to the even control signal terminal C2, a data input terminal A2 connected to the even video signal terminal D2, and even data output terminals 290. The data controller 210 includes a memory 230 having an odd memory 230*a* for storing the odd video signals during the odd numbered pulses of the first clock signal; an even memory 230*b* for storing the even video signals during the even numbered pulses of the first clock signal; and a controller 220 for controlling input and output of the video data. Here, the memory 230, the clock generator 200, and the controller 220 may be integrated on a single IC chip. Also, the paired driver ICs 240, 250 can be integrated on a single IC chip 270.

Figure 8:
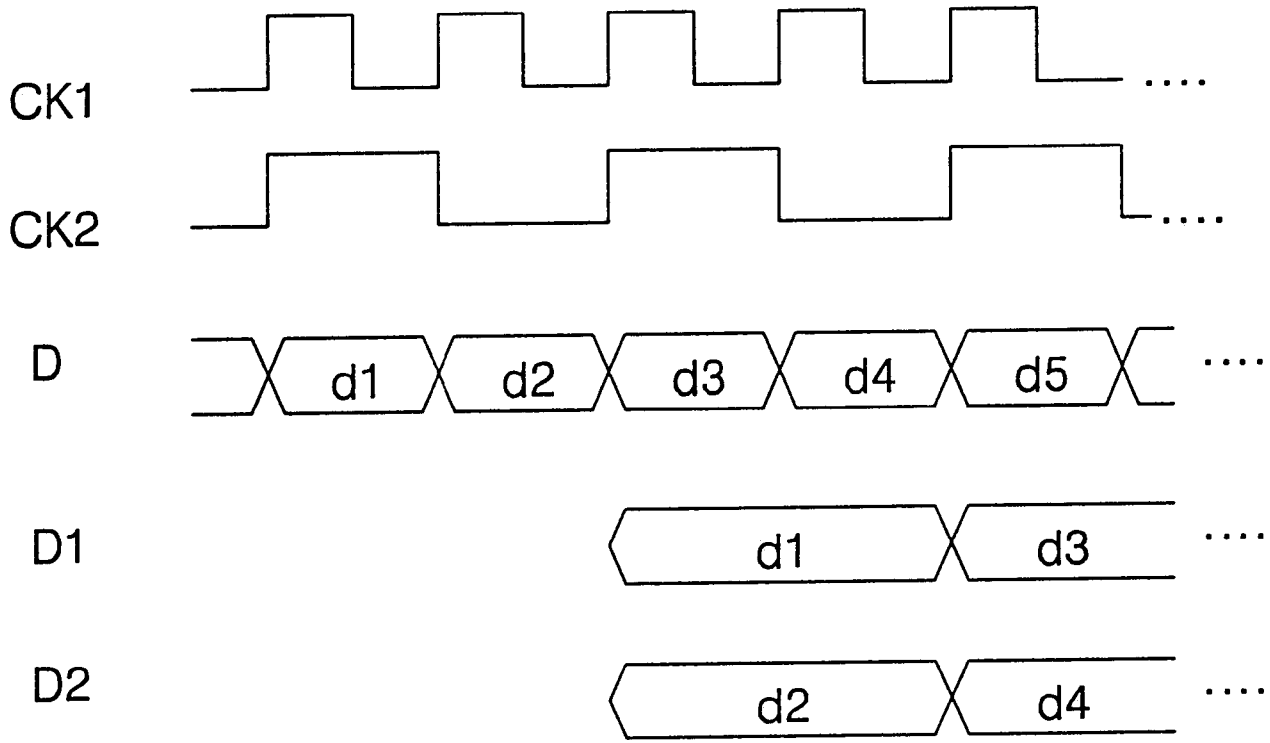
FIG. 8 shows waveforms of signals input to or output from the driving circuit of FIG. 7.

Referring to FIG. 8, which shows the waveforms of the signals input into the output from the driving circuit of the present embodiment, the driving operation is explained. In FIG. 8, the driving process, in which line video data of one-page video data are reproduced, is explained. In the controller IC, a first clock signal is applied. Then, clock generator 200 produces the second clock signal CK2, the period of which is twice that of the first clock signal CK1: i.e., the clock speed of the second clock signal CK2 is half that of the first clock signal CK1. According to the first clock signal CK1, the first odd data (video signal) d1 is stored in the odd memory 230*a* and the first even data (video signal) d2 is stored in the even memory 230*b*. According to the second clock signal CK2, the first odd data d1 and the first even data d2 are sent to the first odd data driver IC 240 and the first even data driver IC 250, respectively. At that time, the second odd data d3 is stored to the odd memory 230*a*, and the second even data d4 is stored to the even memory 230*b* according to the first clock signal CK1. The output of the first pair of data (d1 and d2) and the input of the second pair of data (d3 and d4) are performed at the same time. This is possible because the period of the second clock signal CK2 is twice that of the time clock signal CK1. During the second cycle of the second clock signal CK2 in FIG. 8, the data d1 and d2 are latched at the first odd data driver IC 240 and the first even data driver IC 250, respectively. During the third cycle of the second clock signal CK2, the data d3 and d4 are latched at the second odd data driver IC 240 and the second even data driver IC 250, respectively. After the line data of the one-page data are latched at all the data driver ICs, all the latched data are sent to the data lines at one time.

Second Preferred Embodiment

Figure 9:
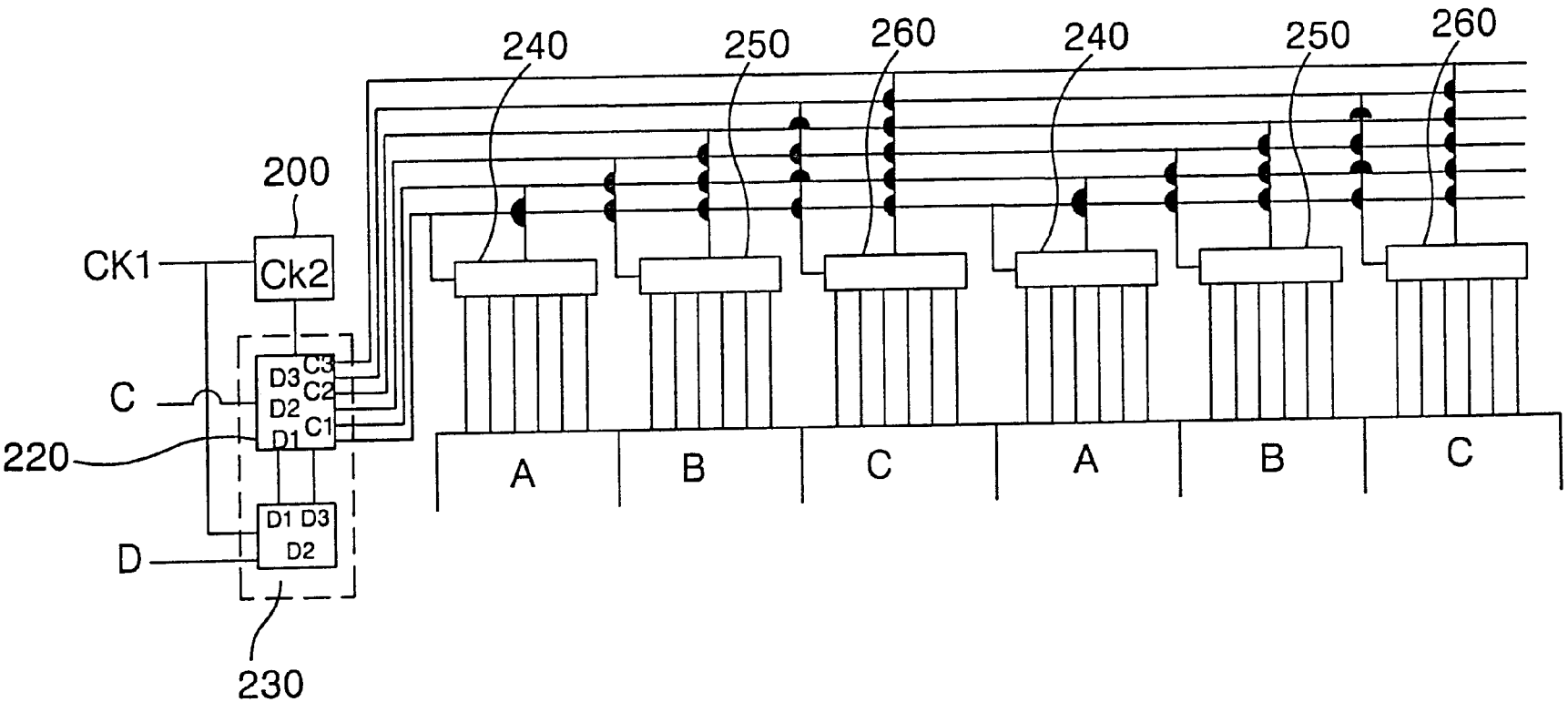
FIG. 9 is a block diagram showing a driving circuit for an LCD according to a second preferred embodiment of the present invention.
Figure 10:
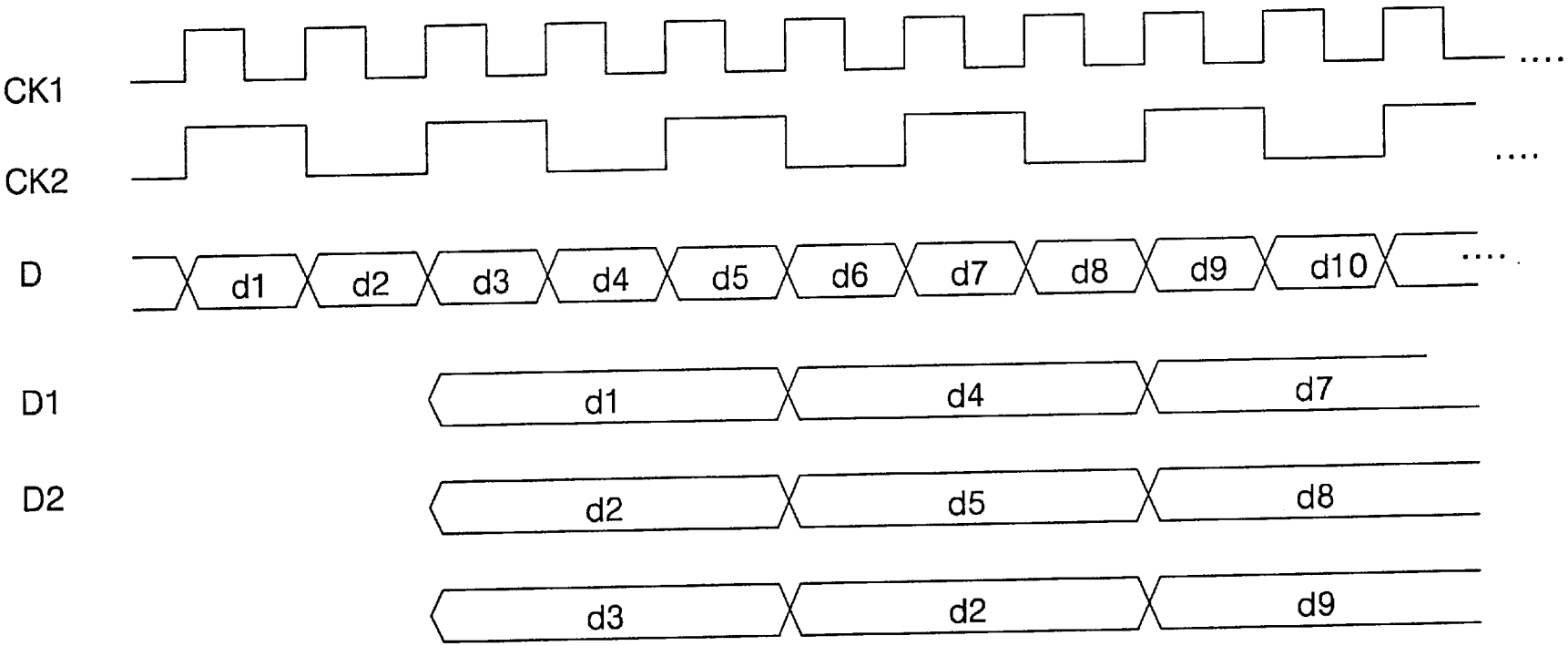
FIG. 10 shows waveforms of signals input to or output from the driving circuit of FIG. 9.

In the first preferred embodiment, the data driver ICs are grouped in pairs. However, the data driver ICs can be grouped into multi-pairs. The second preferred embodiment, as shown in FIG. 9, employs a grouping method according to three areas A, B, and C of the display panel. FIG. 10 shows the waveforms input into the output from the driving circuit of the present embodiment.

According to the first clock signal CK1, the first data d1 for area A, the first data d2 for area B, and the first data d3 for area C are stored in memories 230A, 230B, and 230C in a memory 230'. In accordance with the second clock signal CK3, which is generated at a clock generator 200', the data d1, d2, and d3 are sent to a first A data driver IC 240', a first B data driver IC 250', and a first C data driver IC 260', respectively. Since there are three memories in the memory 230', the frequency (clock speed) of the second clock signal can be a third of that of the clock signal CK1. The cycle of the latching clock signal and the amount of the video memory, etc., are determined so as to optimize the performance of the LCD under given specifications, such as the resolution, the number of color, and the refreshing rate of the screen.

According to the present invention, the data lines of the LCD are connected to a plurality of data driver ICs. The data lines are grouped according to the number of the driver ICs and assigned with the respective driver ICs. The driver ICs are then grouped together (in pairs, for example). Thus, the driver ICs can be grouped into an odd group and an even group. In this case, the odd group driver ICs are connected to an odd memory and the even driver ICs are connected to an even memory. The capacity of each memory should be equal to or greater than the latching capacity of the driver IC. At the first cycle of a clock signal, the video data is stored in the odd and even memory, such that the amount of stored data is the same as the latching amount of the paired driver ICs. At the second cycle of the clock signal, the first odd and first even driver ICs are provided with the video data stored in the odd memory and the even memory, respectively. At the third and fourth cycles of the clock signal, the second paired driver ICs are provided with the video data using the same method.

If an LCD panel has 960 data lines and the driver IC has 80 output terminals, then twelve driver ICs and six pairs of the driver ICs are necessary. The capacity of each memory is 80 bits.

The controller IC according to the present invention includes a memory having a smaller capacity than the conventional controller IC. The capacity of the memory is determined by the grouping method used. The period (clock speed) of the clock signals for the output of the data to the data driver IC is also determined by the grouping method. Therefore, the period of the clock signal that is equal to or longer than twice that of conventional art can be allocated to latch the data to the data driver IC. Also, the data driver ICs are disposed in the single bank mode. Therefore, the present invention achieves the low frequency of the clock signal and the small memory in the controlling circuit, and the high efficiency in panel area usage.

It will be apparent to those skilled in the art that various modifications and variations can be made in the driving circuit for an LCD of the present invention without departing from the spirit or scope of the invention. Thus, it is intended that the present invention cover the modifications and variations of this invention provided they come within the scope of the appended claims and their equivalents.

What is claimed is:

1. A driving circuit for driving a liquid crystal display, comprising:

a clock generator processing a first clock signal to output a second clock signal, a clock speed of the second clock signal being one half of a clock speed of the first clock signal;

a memory for storing first video data and second video data in accordance with the first clock signal; and a data controller for simultaneously outputting the first video data and the second video data stored in the memory in accordance with the second clock signal.

2. The driving circuit according to claim 1, wherein the memory includes:

a first memory for storing the first video data during a first cycle of the first clock signal; and a second memory for storing the second video data during a second cycle of the first clock signal.

3. A driving circuit for driving a liquid crystal display, comprising:

a clock generator processing a first clock signal to output a second clock signal, a clock speed of the second clock signal being one half of a clock speed of the first clock signal;

a memory for storing first video data and second video data in accordance with the first clock signal; and a data controller for directly and simultaneously outputting the first video data and the second video data stored in the memory in accordance with the second clock signal.

* * * * *